US008408397B2

(12) United States Patent
Cady

(10) Patent No.: US 8,408,397 B2
(45) Date of Patent: Apr. 2, 2013

(54) SCREEN FOR A VIBRATORY SEPARATOR

(75) Inventor: Eric Cady, Florence, KY (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 12/757,349

(22) Filed: Apr. 9, 2010

(65) Prior Publication Data

US 2010/0193409 A1 Aug. 5, 2010

Related U.S. Application Data

(63) Continuation of application No. 11/861,848, filed on Sep. 26, 2007, now Pat. No. 7,819,255.

(60) Provisional application No. 60/827,577, filed on Sep. 29, 2006.

(51) Int. Cl.
*B07B 1/49* (2006.01)

(52) U.S. Cl. ..... 209/405; 209/392; 209/395; 209/399; 209/403; 209/404

(58) Field of Classification Search ..... 209/404, 209/405, 392, 393, 395, 397, 412, 403
See application file for complete search history.

(56) References Cited

U.S. PATENT DOCUMENTS

| | | | | |
|---|---|---|---|---|
| 943,869 | A | 12/1909 | Gaston | |
| 1,438,783 | A | 12/1922 | Pessell | |
| 4,498,981 | A * | 2/1985 | Frevert | 209/243 |
| 5,392,925 | A * | 2/1995 | Seyffert | 209/405 |
| 5,501,343 | A * | 3/1996 | Hadden | 209/240 |
| 5,811,003 | A * | 9/1998 | Young et al. | 210/388 |
| 5,927,511 | A | 7/1999 | Riddle et al. | |
| 6,059,119 | A | 5/2000 | Davis | |
| 6,119,868 | A * | 9/2000 | Hiltl | 209/399 |
| 6,325,216 | B1 | 12/2001 | Seyffert et al. | |
| 6,601,709 | B2 | 8/2003 | Schulte, Jr. et al. | |
| 6,759,000 | B2 | 7/2004 | Cook et al. | |
| 7,150,358 | B2 * | 12/2006 | Carr et al. | 209/403 |
| 2005/0258080 | A1 | 11/2005 | Carr et al. | |
| 2007/0125687 | A1 * | 6/2007 | Kutryk | 209/397 |

OTHER PUBLICATIONS

PCT International Search Report issued in PCT Application No. PCT/US2007/080096 dated Feb. 15, 2008 (3 pages).
PCT Written Opinion issued in PCT Application No. PCT/US2007/080096 dated Feb. 15, 2008 (4 pages).
PCT International Preliminary Report on Patentability and Written Opinion of the International Searching Authority in PCT/US2007/080096, issued Mar. 31, 2009, 6 pages.
Notice of Allowance dated Apr. 6, 2010 issued in parent U.S. Appl. No. 11/861,848.
Non-final Office Action dated May 19, 2008 issued in parent U.S. Appl. No. 11/861,848.
Final Office Action dated Jan. 6, 2009 issued in parent U.S. Appl. No. 11/861,848.
Non-final Office Action dated Aug. 21, 2009 issued in parent U.S. Appl. No. 11/861,848.
Extended European Search Report issued Jan. 25, 2013 in corresponding European application No. 07843622.7 (5 pages).

* cited by examiner

*Primary Examiner* — Terrell Matthews
(74) *Attorney, Agent, or Firm* — Osha Liang LLP

(57) ABSTRACT

A shaker apparatus including a basket having an upstream side, a downstream side, and two side walls, at least one wedge guide and one support rail disposed on each side wall, and at least one screen assembly. The support rails and the wedge guides may be configured to engage the screen assembly. The screen assembly may have one or more layers of screen mesh mounted on a screen frame. The screen frame may include a first and a second side rail, each having an upstream end, a downstream end, a top surface, and a bottom surface. A slope of the top surfaces intermediate the upstream end and the downstream end may be different than a slope of the bottom surfaces intermediate the upstream end and the downstream end.

10 Claims, 6 Drawing Sheets

SCREEN FOR A VIBRATORY SEPARATOR

CROSS-REFERENCE TO RELATED APPLICATION

This is a continuation application, and claims benefit under 35 U.S.C. §120 of U.S. patent application Ser. No. 11/861,848, filed on Sep. 26, 2007, which, pursuant to 35 U.S.C. §119(e), claims priority to U.S. Provisional Application Ser. No. 60/827,577, filed Sep. 29, 2006, the disclosure of which is hereby incorporated by reference.

BACKGROUND OF THE INVENTION

1. Field of the Invention

Embodiments disclosed herein relate generally to shale shakers and screens for shale shakers. Specifically, embodiments disclosed herein relate to a shale shaker configured to engage a wedge-like screen frame.

2. Background

Oilfield drilling fluid, often called "mud," serves multiple purposes in the industry. Among its many functions, the drilling mud acts as a lubricant to cool rotary drill bits and facilitate faster cutting rates. The mud is mixed at the surface and pumped downhole through a bore of the drillstring to the drill bit where it exits through various nozzles and ports, lubricating and cooling the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures thereby preventing fluids from blowing out if pressurized deposits in the formation are breeched. Two factors contributing to the hydrostatic pressure of the drilling mud column are the height (or depth) of the column (i.e., the vertical distance from the surface to the bottom of the wellbore) and the density (or its inverse, specific gravity) of the fluid used. Various weighting and lubrication agents are mixed into the drilling mud to obtain the right mixture for the type and construction of the formation to be drilled. Increasing the amount of weighting agent solute dissolved in the mud base will generally create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

Another significant purpose of the drilling mud is to carry the cuttings away from the drill bit to the surface. As a drill bit pulverizes or scrapes the rock formation at the bottom of the borehole, small pieces of solid material are left behind. The drilling fluid exiting the nozzles at the bit stir up and carry the solid particles of rock and formation to the surface within the annulus between the drillstring and the borehole. Therefore, the fluid exiting the borehole from the annulus is a slurry of formation cuttings in drilling mud, and the cutting particulates must be removed before the mud can be recycled.

One type of apparatus used to remove cuttings and other solid particulates from drilling mud is commonly referred to in the industry as a "shale shaker." A shale shaker, also known as a vibratory separator, is a vibrating sieve-like table upon which returning used drilling mud is deposited and through which substantially cleaner drilling mud emerges. Typically, the shale shaker is an angled table with a generally perforated filter screen bottom. Returning drilling mud is deposited at the top of the shale shaker. As the drilling mud travels down the incline toward the lower end, the fluid falls through the perforations to a reservoir below thereby leaving the solid particulate material behind. The combination of the angle of inclination with the vibrating action of the shale shaker table enables the solid particles left behind to flow until they fall off the lower end of the shaker table. The above described apparatus is illustrative of one type of shale shaker known to those of ordinary skill in the art. In alternate shale shakers, the top edge of the shaker may be relatively closer to the ground than the lower end. In such shale shakers, the angle of inclination may require the movement of particulates in a generally upward direction. In still other shale shakers, the table may not be angled, thus the vibrating action of the shaker alone may enable particle/fluid separation. Regardless, table inclination and/or design variations of existing shale shakers should not be considered a limitation of the present disclosure.

Preferably, the amount of vibration and the angle of inclination of the shale shaker table are adjustable to accommodate various drilling mud flow rates and particulate percentages in the drilling mud. After the fluid passes through the perforated bottom of the shale shaker, it may either return to service in the borehole immediately, be stored for measurement and evaluation, or pass through an additional piece of equipment (e.g., a drying shaker, a centrifuge, or a smaller sized shale shaker) to remove smaller cuttings and/or particulate matter.

Screens used with shale shakers are typically emplaced in a generally horizontal fashion on a generally horizontal bed or support within a basket in the shaker. The screens themselves may be flat or nearly flat, corrugated, depressed, or contain raised surfaces. The basket in which the screens are mounted may be inclined towards a discharge end of the shale shaker. The shale shaker imparts a rapidly reciprocating motion to the basket and hence the screens. Material from which particles are to be separated is poured onto a back end of the vibrating screen, flowing toward the discharge end of the basket. Large particles that are unable to move through the screen remain on top of the screen and move toward the discharge end of the basket where they are collected. The smaller particles and fluid flow through the screen and collect in a bed, receptacle, or pan beneath the screen.

In some shale shakers a fine screen cloth is used with the vibrating screen. The screen may have two or more overlaying layers of screen cloth or mesh. Layers of cloth or mesh may be bonded together and placed over a support, supports, or a perforated or apertured plate. The frame of the vibrating screen is resiliently suspended or mounted upon a support and is caused to vibrate by a vibrating mechanism (e.g., an unbalanced weight on a rotating shaft connected to the frame). Each screen may be vibrated by vibratory equipment to create a flow of trapped solids on top surfaces of the screen for removal and disposal of solids. The fineness or coarseness of the mesh of a screen may vary depending upon mud flow rate and the size of the solids to be removed.

While there are numerous styles and sizes of filter screens, they generally follow similar design. Typically, filter screens include a perforated plate base upon which a wire mesh, or other perforated filter overlay, is positioned. The perforated plate base generally provides structural support and allows the passage of fluids therethrough, while the wire mesh overlay defines the largest solid particle capable of passing therethrough. While many perforated plate bases are generally flat or slightly curved in shape, it should be understood that perforated plate bases having a plurality of corrugated or pyramid-shaped channels extending thereacross may be used instead. In theory, the pyramid-shaped channels provide additional surface area for the fluid-solid separation process to take place, and act to guide solids along their length toward the end of the shale shaker from where they are disposed.

The filter screens used in shale shakers, through which the solids are separated from the drilling mud, wear out over time and need replacement. Because shale shakers are typically in continuous use, it is beneficial to minimize repair operations and their associated downtimes. Therefore, shale shaker filter screens are typically constructed to be quickly and easily removed and replaced.

There are currently several ways to secure screens to the shaker, including mechanical or pneumatic clamps, bolts, or wedge blocks that are hammered into place. For example, through the loosening of only a few bolts or the removal of a wedge block, the filter screen can be lifted out of the shaker assembly and replaced.

FIG. 1 illustrates attachment of a screen to a shale shaker 2. One or more shaker screens 4 may be installed in, or secured to, the shale shaker 2 with a wedge block 6. The screen 4 is placed on a support rail (not shown) and positioned underneath a stationary wedge guide 8. The wedge block 6 is then pounded into position so as to secure the screen 4 to the shaker separator 2. One of ordinary skill in the art will appreciate that the operator often chooses to use a combination of a hammer and a suitable piece of wood in contact with the wedge block 6 to deliver sufficient force to fully tighten the wedge block 6. As shown in FIG. 1, the wedge block 6 may also include a hammer surface 10 to aid in installation (as by pounding on surface 10*a*) and removal (as by pounding on surface 10*b*). Some prior art shale shakers have a hole-and-pin system to secure the position of the shaker screen 4 on the sealing surface of the shale shaker 2 during installation of the shaker screen 4 and tightening of the wedge block 6.

A similar basket and screen assembly is disclosed in U.S. Pat. No. 5,811,003, issued to Young, et al. The '003 patent discloses a separator screen installation system, including wedge blocks and vertical side rails. The screen frame rests upon support rails and the vertical side rails are positioned between the wedges and the screen. The wedges are hammered into engagement with a wedge angle, thereby applying a downward force on the side rails and the screen, securing them in place. The side rails may be fixed to the separator screen, and the side rails may be tapered down from the downstream end to the upstream end.

Due to the vibration or shaking of the screen separator, many parts in the separator may wear over time. Additionally, when using additional parts such as wedge blocks, the fine screen mesh may be easily damaged or ruined by accidentally dropping the wedge block or other parts onto the mesh. When the mesh is punctured in this manner on a new screen during installation, the screen must be replaced.

Accordingly, there exists a need for a screen frame that will reduce the downtime required to change screens. There also exists a need for a screen frame that will reduce the chance of damage to the screen during installation. It is also desired to minimize the number of parts that may wear due to the vibration and shaking of the screen separator.

SUMMARY OF INVENTION

In one aspect, embodiments disclosed herein relate to a shaker apparatus including a basket having an upstream side, a downstream side, and two side walls, at least one wedge guide and one support rail disposed on each side wall, and at least one screen assembly. The support rails and the wedge guides may be configured to engage the screen assembly.

In another aspect, embodiments disclosed herein relate to a shaker apparatus where the support rails and the wedge guides may be configured to engage the screen assembly, where the screen assembly may have one or more layers of screen mesh mounted on a screen frame. The screen frame may include a first and a second side rail, each having an upstream end, a downstream end, a top surface, and a bottom surface. A slope of the top surfaces intermediate the upstream end and the downstream end may be different than a slope of the bottom surfaces intermediate the upstream end and the downstream end.

In another aspect, embodiments disclosed herein relate to a screen assembly having one or more layers of screen mesh mounted on a screen frame. The screen frame may include a first and a second side rail, each having an upstream end, a downstream end, a top surface, and a bottom surface. A slope of the top surfaces intermediate the upstream end and the downstream end may be different than a slope of the bottom surfaces intermediate the upstream end and the downstream end.

Other aspects and advantages of the invention will be apparent from the following description and the appended claims.

DETAILED DESCRIPTION

In one aspect, embodiments disclosed herein relate to a screen assembly for an oilfield shale shaker, where the screen assembly includes screen mesh disposed on a screen frame. Specifically, embodiments disclosed herein relate to a shale shaker configured to engage a wedge-like screen frame. In some embodiments, a wedge-like screen frame may include side rails, wherein a slope of the top surface of the side rails is different than a slope of the bottom surface of the side rails.

Embodiments of the screen frame disclosed herein may not require bolts, clamps, or additional parts such as wedge blocks, to hold a screen in place. Additionally, embodiments disclosed herein relate to a screen frame that may limit the occurrence of accidental damage to the screen or may reduce the time required to change or install the screen frame in a shale shaker.

Figure 1:
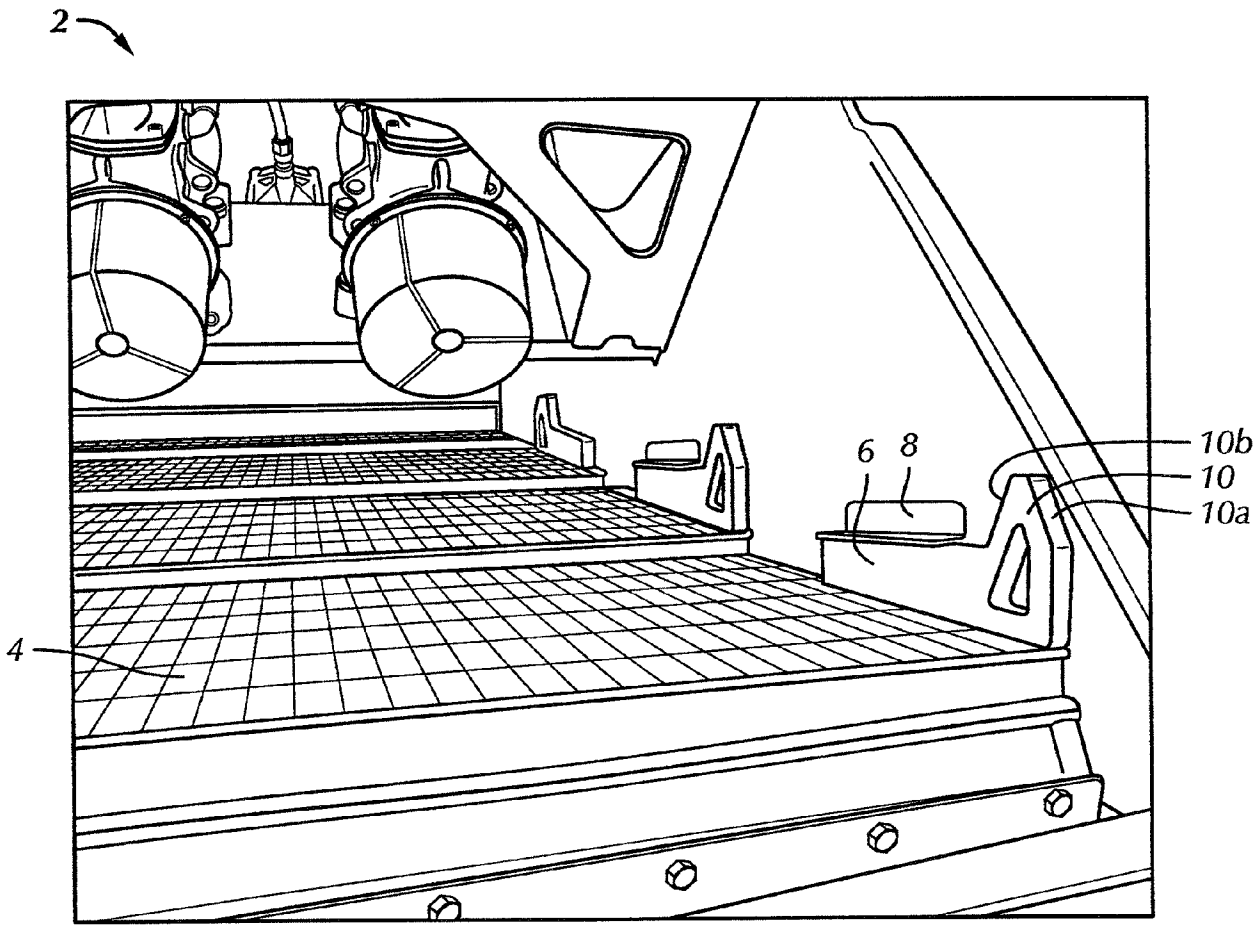
FIG. 1 PRIOR ART
FIG. 1 is a schematic drawing of a prior art method to attach a screen assembly to a shale shaker.
Figure 2:
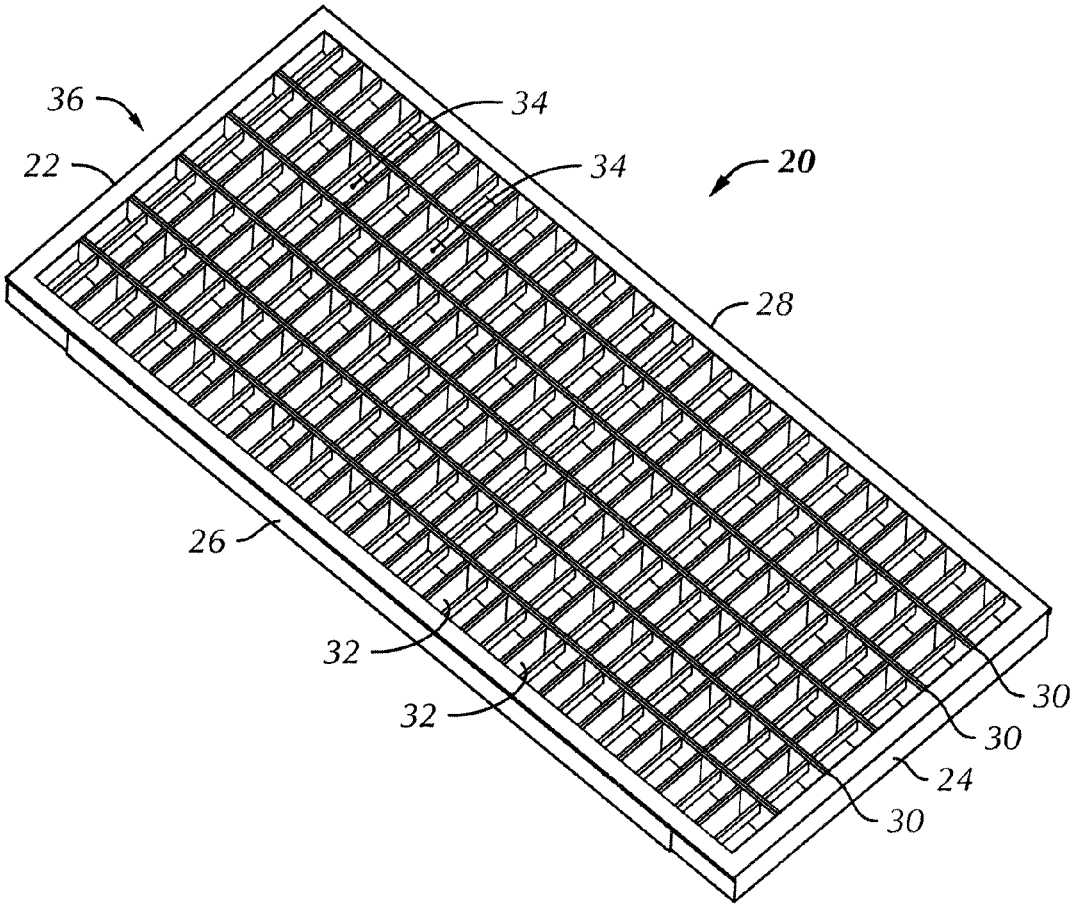
FIG. 2 is a schematic drawing of a screen frame in accordance with embodiments disclosed herein.

Referring initially to FIG. 2, a screen frame 20 for an oilfield shaker in accordance with an embodiment of the present invention is shown. The screen frame 20 has a first side rail 22 and a second side rail 24 extending between a first end 26 and a second end 28. At least one longitudinal cross-member 30 may extend between first end 26 and second end 28, disposed between first side rail 22 and second side rail 24. A plurality of transverse ribs 32 is arrayed between first end 26 and second end 28, intersecting with and supported by longitudinal cross-members 30, forming a plurality of perforations 34 between transverse ribs 32. A layer or more of mesh (not shown) may be placed on upper surface 36 and may cover perforations 34 such that solid particles larger than a designated mesh size, in a slurry flowing across the screen disposed on screen frame 20, will not pass through the screen and the screen frame 20.

In one embodiment, screen frame 20 may be formed from any material known in the art, for example, stainless steel, metal alloys, plastics, etc. In a preferred embodiment, screen frame 20 may be formed from a composite material. In this embodiment, the composite material may include high-strength plastic and glass, reinforced with steel. Composite screen frames may provide more consistent manufacturing of the frame and may more evenly distribute mechanical stresses throughout the screen frame during operation. In another embodiment, screen frame 20 may include composite material formed around a steel or wire frame. In other embodiments, the screen frame 20 may be formed by injection molding. U.S. Pat. No. 6,759,000 discloses a method of forming a screen frame by injection molding and is herein incorporated by reference in its entirety. For example, in one embodiment, screen frame 20, having a wire frame and a composite or polymer material, may be formed by first placing a reinforcing wire frame assembly including at least a first end, a second end, a first side, a second side, and at least one cross-member in a mold tool. The mold tool may then be closed and liquid polymer may be injected into the mold tool by injection molding so as to wholly encapsulate the wire frame and to form an article having an open central region crisscrossed by transverse ribs bounded on each side by the screen frame 20. An inward force is then exerted on opposite faces of the wire frame assembly within the mold tool by fingers protruding inwardly from inside faces of the mold tool, the fingers being operable to engage the reinforcing wire frame when the mold tool closes. The fingers include inwardly projecting pegs which align with crossing points of wires to space the reinforcing wire frame from corresponding upper and lower internal surfaces of the mold tool and ensure that the reinforcing wire frame is buried within the polymer or composite material which is injected into the mold tool during the manufacturing process. The polymer or composite material is allowed to cure and then the screen frame 20 may be removed from the mold tool.

In some embodiments, the screen frame may include a top and bottom surface that are not parallel. In other embodiments, the screen frame may include a top and bottom surface that are not parallel, resulting in the screen frame having a trapezoidal or wedge-like profile as viewed from the side. The unparallel surfaces may be used to wedge the screen into place without requiring any additional parts, such as wedge blocks or clamps. Various embodiment of the screen frame, where the screen frame includes top and bottom surfaces that are not parallel to each other, are illustrated in FIGS. 3-6.

Figure 3A:
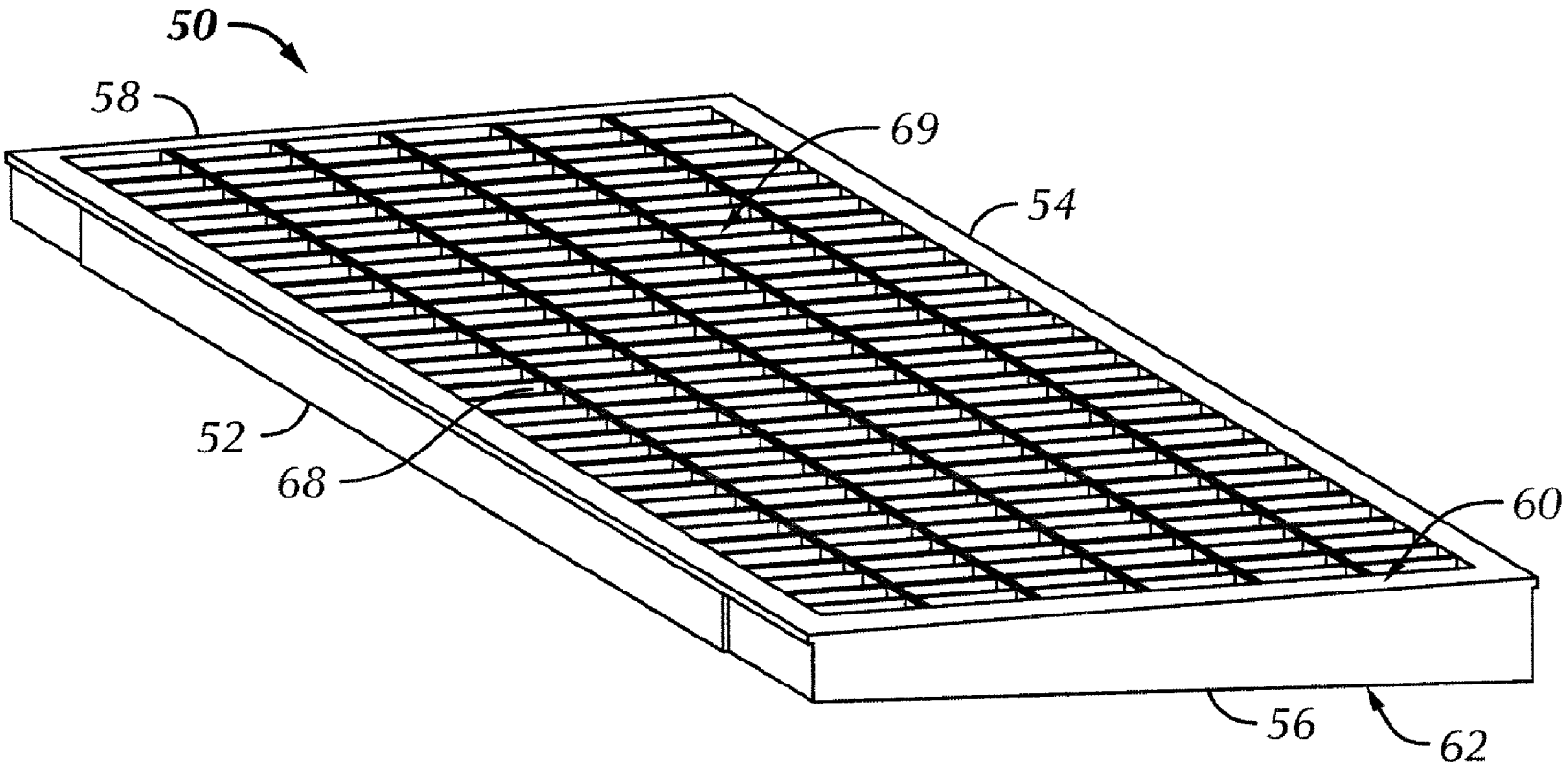
FIGS. 3A and 3B are schematic drawings of a screen assembly and screen frame according to embodiments disclosed herein.
Figure 3B:
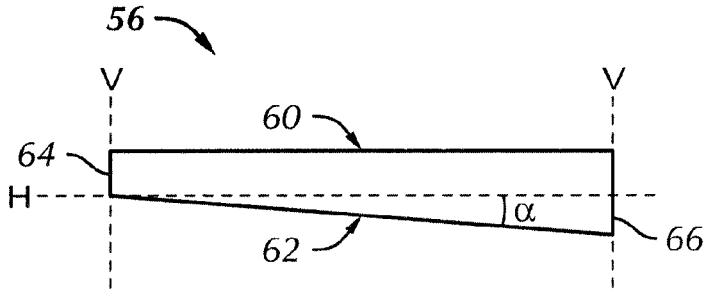

Referring now to FIGS. 3A and 3B, screen frame 50 may include an upstream rail 52 and a downstream rail 54 extending between a first side rail 56 and a second side rail 58. As described above, screen frame 50 may also include transverse ribs, longitudinal cross-members, and a plurality of perforations. The first side rail 56 and second side rail 58 may each have a top surface 60 and a bottom surface 62, wherein the slope of the surfaces 60, 62 are not parallel, resulting in a side rail 56, 58 having a trapezoidal profile. The side rails 56, 58 may thus act as a wedge, negating the need for the use of wedge blocks or other attachment devices for securing screen frame 50 to a shale shaker (not shown).

As illustrated in FIG. 3B, the vertical height of the side rail 56 proximate the downstream end 64 may be less than the vertical height of the side rail 56 proximate the upstream end 66. In other embodiments, a taller portion of the side rails may be located on either the upstream portion of the screen assembly or the downstream portion of the assembly, as both will effectively hold the screen in place.

Still referring to FIGS. 3A and 3B, the top surfaces 60 of the first and second side rails 56, 58 may be perpendicular or substantially perpendicular to a vertical axis V of each respective side rail 56, 58. As the top surface 60 is perpendicular to the vertical axis V, the bottom surface 62 is not perpendicular to the axis V, such that the top surface 60 and bottom surface 62 are not parallel. Accordingly, bottom surface 62 may form any angle $\alpha$ with a horizontal axis H, such as 1°, 5°, 10°, 15°, etc., for example. In various embodiments, angle $\alpha$ may be any angle within a range from about 1° to about 45°; from 1° to 30° in other embodiments; and from 5° to 20° in yet other embodiments.

Other embodiments of screen frame 50 are illustrated in FIGS. 4-7, where like numerals represent like parts. Referring now to the embodiment of screen frame 50 illustrated in FIG. 4, the bottom surface 62 of the side rails 56, 58 may be perpendicular to vertical axis V, while the top surface 60 is not perpendicular to vertical axis V. Accordingly, top surface 60 may form any angle $\alpha$ with a horizontal axis H, such as 1°, 5°, 10°, 15°, etc., for example. In various embodiments, angle $\alpha$ may be any angle within a range from about 1° to about 45°; from 1° to 30° in other embodiments; and from 5° to 20° in yet other embodiments.

Figure 4:
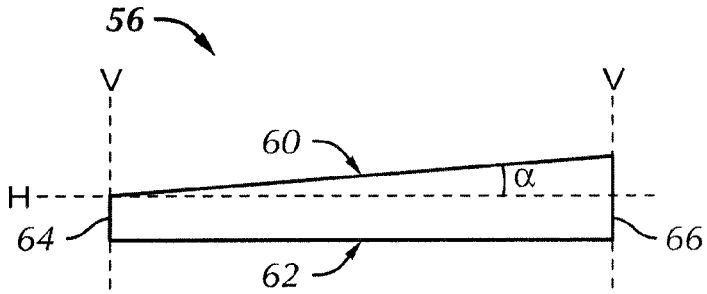
FIG. 4 is a schematic drawing of a profile of a screen frame according to embodiments disclosed herein.
Figure 5:
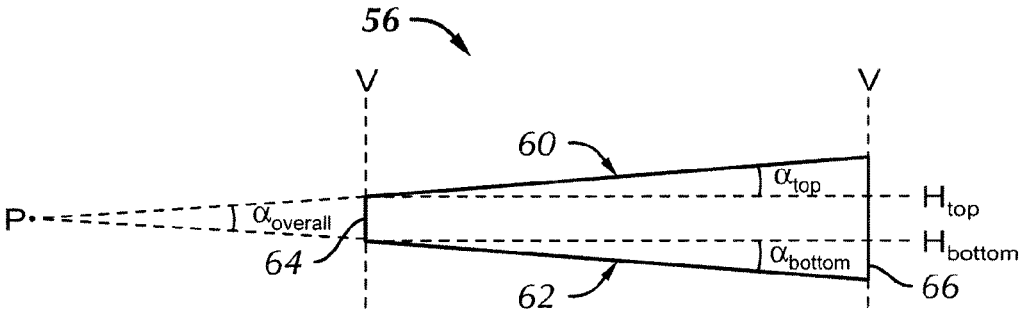
FIG. 5 is a schematic drawing of a profile of a screen frame according to embodiments disclosed herein.

In the embodiment of the screen frame 50 illustrated in FIG. 5, both the top and bottom surfaces 60, 62 of the side rails 56, 58 are not perpendicular to the vertical axis V. Accordingly, bottom surface 62 may form any angle $\alpha_{bottom}$ with a horizontal axis $H_{bottom}$, such as 1°, 5°, 10°, 15°, etc., for example. In various embodiments, angle $\alpha_{bottom}$ may be any angle within a range from about 1° to about 45°; from 1° to 30° in other embodiments; and from 5° to 20° in yet other embodiments. Additionally, top surface 60 may form any angle $\alpha_{top}$ with a horizontal axis $H_{top}$, such as 1°, 5°, 10°, 15°, etc., for example. In various embodiments, angle $\alpha_{top}$ may be any angle within a range from about 1° to about 45°; from 1° to 30° in other embodiments; and from 5° to 20° in yet other embodiments. Angle $\alpha_{top}$ and angle $\alpha_{bottom}$ may be the same or different. Preferably, angle $\alpha_{top}$ and angle $\alpha_{bottom}$ may diverge or converge at an overall angle $\alpha_{overall}$. In some embodiments, angle $\alpha_{overall}$ may be any angle within a range from about 1° to about 60°; from about 1° to about 30° in other embodiments; and from about 1° to about 20° in yet other embodiments. (In the embodiments of FIGS. 3 and 4, $\alpha_{overall}$ would be identical to $\alpha$ as one surface, either top surface 60 or bottom surface 62, is substantially horizontal.)

Referring back to FIG. 3A, a screen 68 may be installed on the top surface 60, where the surface 69 of the screen 68 may also be substantially perpendicular to the vertical axis proximate the side rails 56, 58. As illustrated in FIG. 4 or 5, a surface 69 of a screen 68 installed on the top surface 60 may not be perpendicular to the vertical axis V proximate the side rails 56, 58. Although a screen 68 disposed on the top surface 60 of the screen frame necessarily conforms to the shape of the top surface 60 proximate the rails, an interior portion of the screen surface 69 may conform to the structure of the ribs and cross-members (not shown). For example, a screen frame 50 may have one or more ribs or cross-members (not shown) that extend to a vertical height above or below top surface 60 to disperse a slurry across surface 69 of screen 68 for separation.

Figure 6:
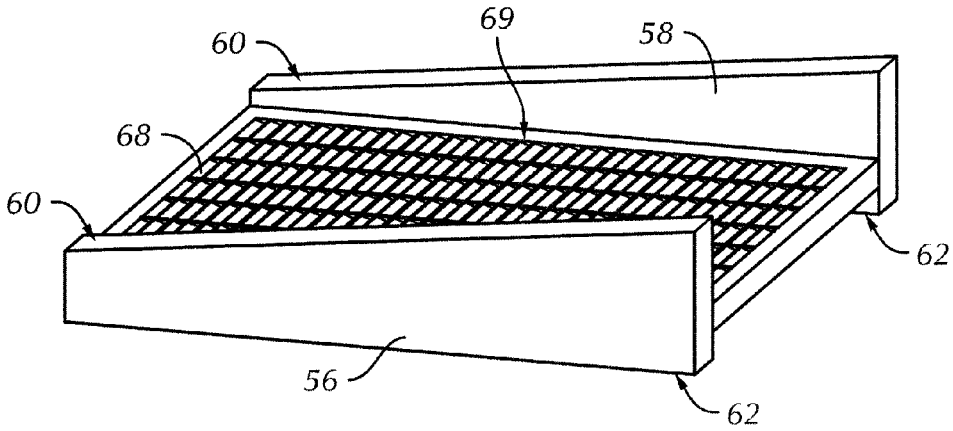
FIG. 6 is a schematic drawing of a screen assembly and screen frame in accordance with embodiments disclosed herein.

As is illustrated in FIG. 6, in some embodiments, a screen 68 may be installed intermediate the top and bottom surfaces 60, 62 of the side rails 56, 58. The top and/or bottom surfaces 60, 62 of the side rails 56, 58 may not be perpendicular to the vertical axis V. In this manner, the unparallel surfaces 60, 62 could be located under the wedge guide (not shown), while screen surface 69 may be any desired contour, not restricted by the shape of the screen frame 50 proximate the side rails 56, 58.

Figure 7:
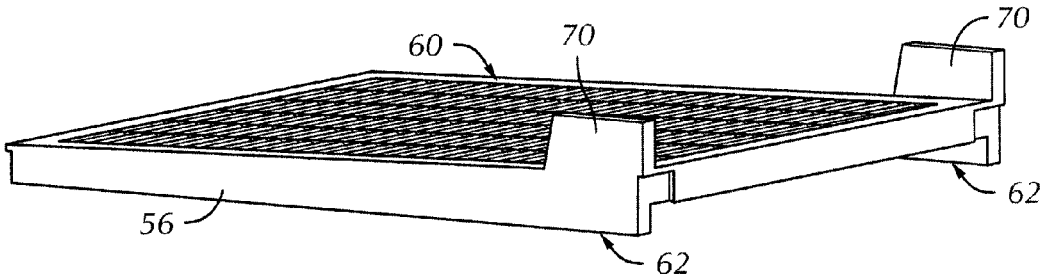
FIG. 7 is a schematic drawing of a screen assembly and screen frame having a hammer arm extending upward from the screen frame in accordance with embodiments disclosed herein.

In other embodiments, hammer surfaces or hammer arms may also be included. As illustrated in FIG. 7, a hammer arm 70 may extend from one or both of the top surfaces 60 of the side rails 56, 58. In other embodiments, one or more hammer arms 70 may extend from the top surface 60, bottom surface 62, or both the top and bottom surfaces 60, 62 of the side rails 56, 58.

Figure 8:
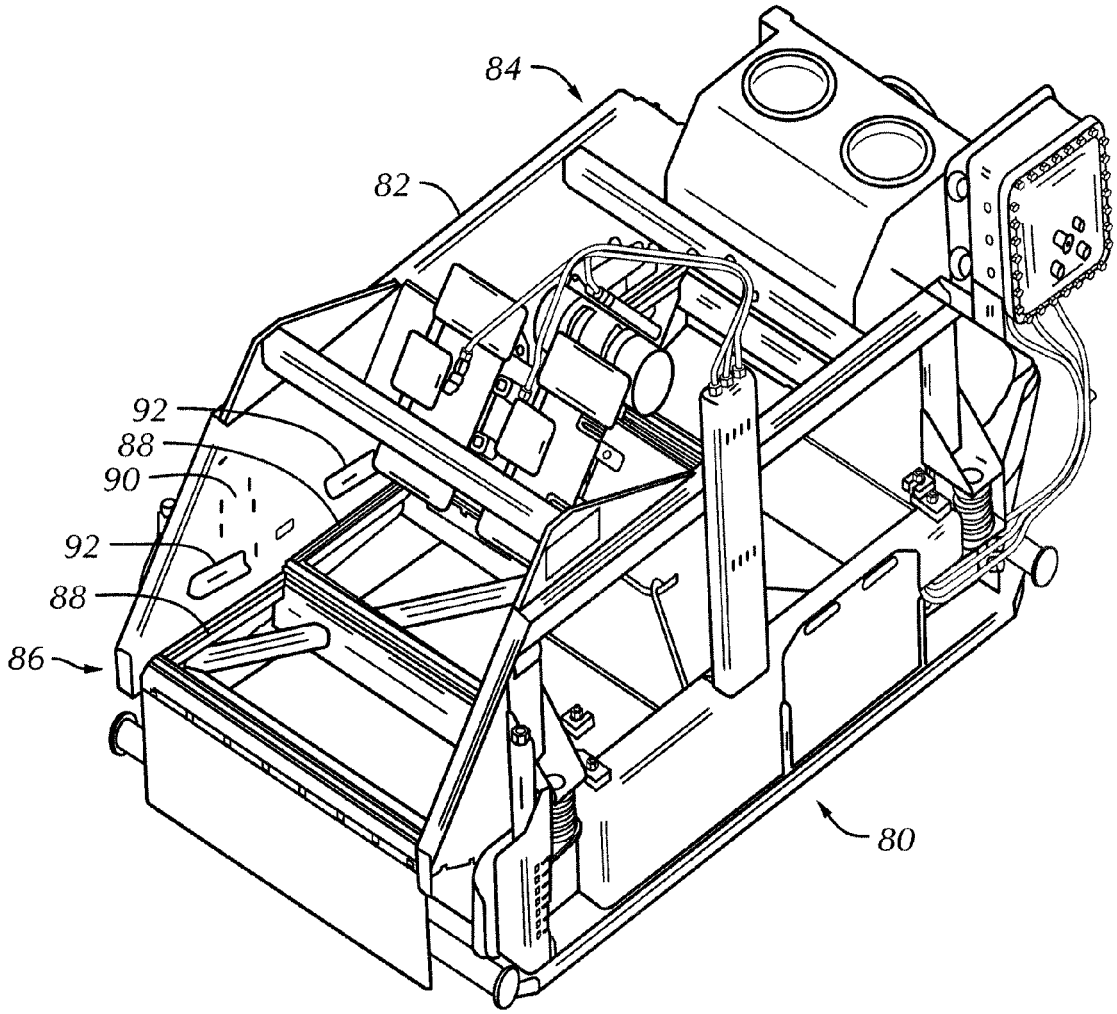
FIG. 8 is a schematic drawing of a shale shaker configured to engage the screen assemblies in accordance with embodiments disclosed herein.

FIG. 8 illustrates an embodiment of a shale shaker 80 configured to engage a screen frame as described above. The screen frame may be any screen frame disclosed herein or have any combination of any feature or features of any screen frame or screen part disclosed herein; and any such screen frame may be used with any appropriate shaker or screening apparatus. The shale shaker 80 may include a shaker basket 82 having an upstream side 84 and a downstream side 86, and may include one or more support rails 88 attached or integral with the side walls 90 of the basket 82. A wedge guide 92 may be disposed on the side walls 90 above the support rails 88. A screen frame, as described above, may be installed between the support rails and wedge guide. The support rails 88 and wedge guide 92 are configured to engage the screen frame, securing the screen frame in place during operation. In this manner, the screen frame may be installed without the need for bolts, clamps, or additional parts such as wedge blocks, to hold the screen in place. Drilling mud returning from the borehole may be washed across a screen mesh on the screen frame such that the drilling fluid passes through the screen perforations, separating the drilling fluids from the solids.

In some embodiments, a screen frame installed in shale shaker 80 provides an angled upper surface such that the solids left behind upon the screen continue to "flow" along the screen frame upper surface until they fall off an edge of the screen frame into a hopper, conveyor belt, or other collection means. In some embodiments, the support rails 88 may be angled to provide the slope required. In other embodiments, the slope of the support rails 88 may be adjustable, accommodating various drilling fluid flow rates and solids content. In other embodiments, the slope of a screen from the upstream rail to the downstream rail may provide the desired angle. The slope of the support rails and/or the screen surface between the upstream and downstream rails used may depend on the screen mesh size and the flow rate of drilling mud and cuttings passing over and through the screen, and the slope may be inclined, declined, or substantially horizontal.

In some embodiments, a gasket or seal may be disposed along a perimeter of screen frame. When the screen frame is installed in the shale shaker (not shown), the gasket may be compressed between the screen frame and a sealing surface (not shown) of the shale shaker, thereby sealing the screen frame. The gasket may include a D-shaped, hollow gasket, a solid gasket, or a nitrile gasket. In another embodiment, the gasket may be formed from a thermoset resin or thermoplastic resin. In one embodiment, the gasket may be formed from, for example, polychloroprene or polypropylene. In yet another embodiment, the gasket may include a thermoplastic vulcanizate (TPV). TPVs are high-performance elastomers that combine desirable characteristics of vulcanized rubber, for example, flexibility and low compression set, with processing ease of thermoplastics. TPVs may be injection molded, extruded, blow molded, and thermoformed. One such commercially available TPV is SANTOPRENE™ provided by ExxonMobile Chemical (Houston, Tex.).

In one embodiment, the gasket may be coupled to the screen frame by any method known in the art. For example, an adhesive may be applied to a surface of the gasket. In one embodiment, the gasket may be formed by injecting a thermoset resin, thermoplastic resin or TPV into a mold. In another embodiment, the gasket may be integrally molded with a composite screen frame. In this embodiment, the composite screen may be positioned within a mold tool. Once the mold tool is closed, TPV, for example, may be injected into the mold tool. The TPV is allowed to cure and then the screen frame having an integrally molded gasket on the screen frame is removed.

Advantageously, embodiments disclosed herein may provide a screen assembly that may be installed without the use of additional parts, reducing the potential for accidental damage of the screen due to handling of fewer parts. Fewer parts in the separator may also reduce the cost and time to manufacture the separator and screen assemblies and may reduce the number of parts subject to wear due to vibration of the shaker. Additionally, embodiments disclosed herein may provide a screen frame that allows for quick and easy installation and removal, reducing the downtime required to change screens.

While embodiments have been described with respect to a limited number of embodiments, those skilled in the art, having benefit of this disclosure, will appreciate that other embodiments can be devised which do not depart from the scope of embodiments disclosed herein. Accordingly, the scope of embodiments disclosed herein should be limited only by the attached claims.

What is claimed is:

1. A screen assembly configured to directly engage support rails and wedge guides of a shaker apparatus, the screen assembly comprising one or more layers of screen mesh mounted on a screen frame, the screen frame comprising:
- a first and a second side rail, each having an upstream end, a downstream end, a top surface and a bottom surface,
- wherein a slope of the top surfaces intermediate the upstream end and the downstream end is different than a slope of the bottom surfaces intermediate the upstream end and the downstream end; and
- wherein, independent of screen mesh placement, either:
  - a vertical height of the side rails proximate the downstream end is greater than a vertical height of the side rails proximate the upstream end; or
  - a vertical height of the side rails proximate the upstream end is greater than a vertical height of the side rails proximate the downstream end.

2. The screen assembly of claim 1, further comprising at least one hammer arm.

3. The screen assembly of claim 1, wherein the screen mesh is disposed intermediate the top surface and the bottom surface of the side rails.

4. The screen assembly of claim 1, wherein the screen mesh is disposed on the top surface of the side rails.

5. The screen assembly of claim 1, wherein the top surface of the first and second side rails is substantially perpendicular to a vertical axis of both the first and second side rails.

6. The screen assembly of claim 5, wherein the bottom surface of the first and second side rails forms an overall angle of between 1° and 45° with the top surface of the first and second side rails.

7. The screen assembly of claim 1, wherein the bottom surface of the first and second side rails is substantially perpendicular to a vertical axis of both the first and second side rails.

8. The screen assembly of claim 7, wherein the top surface of the first and second side rails forms an overall angle of between 1° and 45° with the bottom surface of the first and second side rails.

9. The screen assembly of claim 1, wherein the top surface of the first and second side rails is not perpendicular to a vertical axis of both the first and second side rails, and wherein the bottom surface of the first and second side rails is not perpendicular to a vertical axis of both the first and second side rails.

10. The screen assembly of claim 9, wherein the bottom surface of the first and second side rails forms an overall angle of between 1° and 45° with the top surface of the first and second side rails.

* * * * *